US006070503A

United States Patent [19]

Shiao

[11] Patent Number: 6,070,503

[45] Date of Patent: Jun. 6, 2000

[54] HIGH TORSION RATCHETING DRIVER HANDLE

[76] Inventor: Hsuan-Sen Shiao, No. 15-1, Lane 369, Min-Chuan Rd., Taichung City, Taiwan

[21] Appl. No.: 09/158,578

[22] Filed: Sep. 22, 1998

[51] Int. Cl.[7] ..... B25B 13/46

[52] U.S. Cl. ..... 81/63.2; 81/63

[58] Field of Search ..... 81/63.2, 63

[56] References Cited

U.S. PATENT DOCUMENTS

| | | | |
|---|---|---|---|
| 4,869,138 | 9/1989 | Farris | 81/63.2 |
| 5,568,751 | 10/1996 | Lee | 81/63 |
| 5,626,062 | 5/1997 | Colvin | 81/63.2 |
| 5,711,193 | 1/1998 | Eggert et al. | 81/63.2 |
| 5,873,286 | 2/1999 | Van Lenten | 81/63.2 |

*Primary Examiner*—David A. Scherbel
*Assistant Examiner*—Daniel G. Shanley
*Attorney, Agent, or Firm*—Foley & Lardner

[57] ABSTRACT

A ratcheting handle includes an elongated body having an end portion formed with an inner annular wall that extends in an axial direction to define an axial hole. A ratcheting mechanism is disposed in the axial hole, and includes a gear member that is disposed to be coaxial and rotatable in the axial hole and that has a coupling end engaging a shank of the associated driver bit, and a rim portion disposed around the axial direction. The rim portion is provided with a tooth member that is spaced apart from the annular wall in a radial direction to define an annular chamber therebetween. The ratcheting mechanism further includes a pawl member disposed in the annular chamber, and having a fulcrum point lying in a fulcrum line parallel to the axial direction, and first and second tooth portions disposed at two sides of the fulcrum line in such a manner that one of the tooth portions engages the tooth member when the fulcrum point is shifted between first and second positions along a line parallel to a chord of the gear member. A spring includes a mounting end secured to the fulcrum point, and a free end that extends angularly from the mounting end and that is slidably retained in first and second anchored points on the annular wall.

6 Claims, 7 Drawing Sheets

HIGH TORSION RATCHETING DRIVER HANDLE

BACKGROUND OF THE INVENTION

1. Field of the Invention

The invention relates to a screw driver handle, more particularly to a high torsion ratcheting driver handle.

2. Description of the Related Art

Referring to FIGS. 1 and 2, a conventional driver handle for a driver bit is shown to include an elongated body 1, a ratcheting mechanism 2, a turnable disc 6, a spring member 9, a selector cap 7 and a shank 8.

As illustrated, the elongated body 1 has an end portion formed with an inner annular wall 111A that extends in an axial direction to define an axial hole 112A which opens at the end portion. The ratcheting mechanism 2 includes an elongate ratcheting housing 201 disposed in the axial hole 112, and has an end wall formed with an axial bore 2*a* to receive a gear member 3 therein and two lateral pawl receiving holes 2*b* in communication with the axial bore 2*a* to receive left and right spring-biased pawl units 4, 5, respectively, therein such that the tooth portions 5*a* of the latter mesh with the gear member 3. The end wall of the ratcheting housing 201 further has two spring-retaining curved slots 2*c* formed therethrough. The gear member 3 defines a non-circular hole 3*a* that extends in the axial direction and that accommodates the shank 8 non-rotatably therein. The turnable disc 6 is disposed for turning around the axial direction in the clockwise and counterclockwise directions, and has a central hole for passage of the shank 8 and an axially extending tongue 6*a* that projects into the axial bore 2*a* of the ratcheting housing 201 to abut against the tooth portion of the right pawl unit 5 so as to the prevent engagement between the gear member 3 and the right pawl unit 5. Two end portions 9*a* of the spring member 9 extend in the axial direction through two insert holes 6*c* of the turnable disc 6 and engage the curved slots 2*c* of the ratcheting housing 201 to provide a resilient retarding force during turning of the turnable disc 6. The selector cap 7 has a central hole for passage of the shank 8, and a plurality of angularly spaced plugs 7*a* inserted into socket holes 6*b* of the turnable disc 6 so as to transmit turning of the selector cap 7 to the turnable disc 6.

A disadvantage of the conventional ratcheting driver handle resides in that the spring members 4 of the pawl units 5 must be maintained at an appropriate tension force because, in case the tension is considerable strong, the user must exert a considerable force to turn the elongated body 1 in the clockwise direction in order to cause idle rotation of the ratcheting housing 201 relative to the gear member 3. In addition, because only one of the pawl units 5 is engaged to the gear member 3, thereby providing a poor torque on a workpiece when the elongated body 1 is turned about the axial direction in the counterclockwise direction in order to perform a tightening operation.

SUMMARY OF THE INVENTION

Therefore, the object of this invention is to provide a ratcheting driver handle for a driver bit which is clear of the aforementioned disadvantages that are generally associated with the conventional ratcheting driver handle.

Accordingly, a ratcheting driver handle for a driver bit of this invention includes an elongated body, a ratcheting mechanism, a spring member, a retaining member, first and second barrier members, and a shank. The elongated body has an end portion formed with an inner annular wall that extends in an axial direction to define an axial hole. The axial hole opens at the end portion. The ratcheting mechanism is disposed in the axial hole, and includes a gear member that is disposed to be coaxial and rotatable relative to the axial hole. The gear member has a coupling end adapted to engage the shank of the driver bit, and a rim portion disposed around the axial direction. The rim portion is provided with a tooth member that is spaced apart from the annular wall in a radial direction to define an annular chamber therebetween. The ratcheting mechanism further includes a pawl member disposed in the annular chamber, and having a fulcrum point lying in a fulcrum line parallel to the axial direction, and first and second tooth portions disposed at two sides of the fulcrum line opposing each other in such a manner that one of the first and second tooth portions engages with the tooth member when the fulcrum point is shifted between first and second positions along a line parallel to a chord line relative to the gear member. The spring member includes a mounting end secured to the fulcrum point, and a free end that extends angularly from the mounting end around the gear member. The free end is slidably retained in first and second anchored points that are disposed angularly on the inner annular wall when the fulcrum point is shifted between the first and second positions, respectively. The retaining member is disposed on the inner annular wall to slidably anchor the free end at, in a clockwise direction, a downstream location which corresponds to the second anchored point, and an upstream location which corresponds to the first anchored point. The tooth member is ratcheted by the second tooth portion in a counterclockwise direction against a first biasing action of the spring member generated when the free end is at the second anchored point and the mounting end is at the second position. The tooth member is ratcheted by the first tooth portion in the clockwise direction against a second biasing action generated when the free end is at the first anchored point and the mounting end is at the first position. The first and second barrier members are disposed respectively to hinder the disengaged one of the first and second tooth portions from moving away from the tooth member in the radial direction when one of the first and second tooth portions is brought to engage the tooth member by shifting the fulcrum point between the first and second positions, thereby pulling or pushing the mounting end so as to drag or to move over the free end into the upstream location or the downstream location, respectively.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENTS

Figure 1:
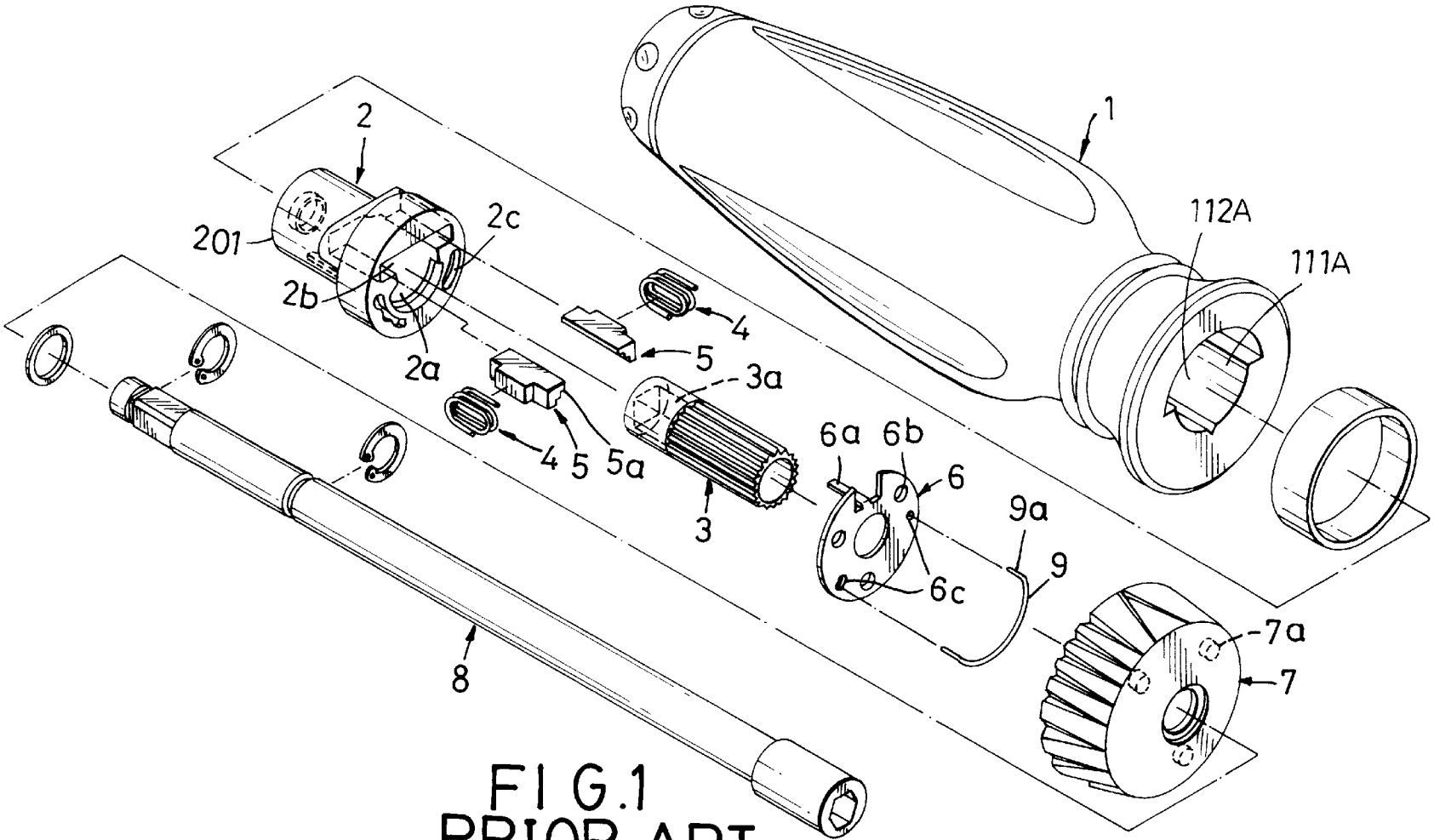
FIG.1 PRIOR ART
FIG. 1 is an exploded view of a conventional ratcheting driver handle.
Figure 2:
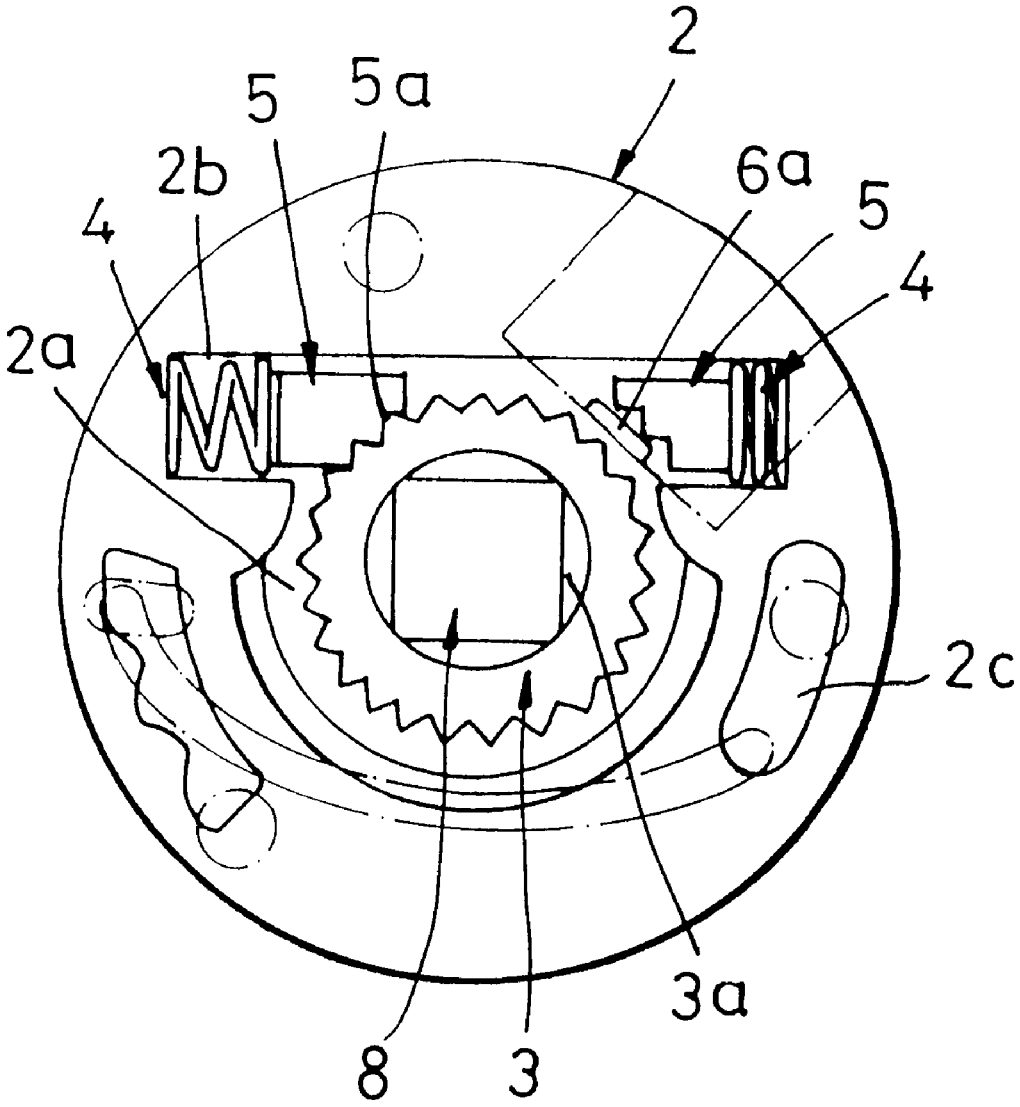
FIG. 2 PRIOR ART
FIG. 2 is a cross sectional view of the conventional ratcheting driver handle, illustrating the internal configuration thereof.
Figure 3:
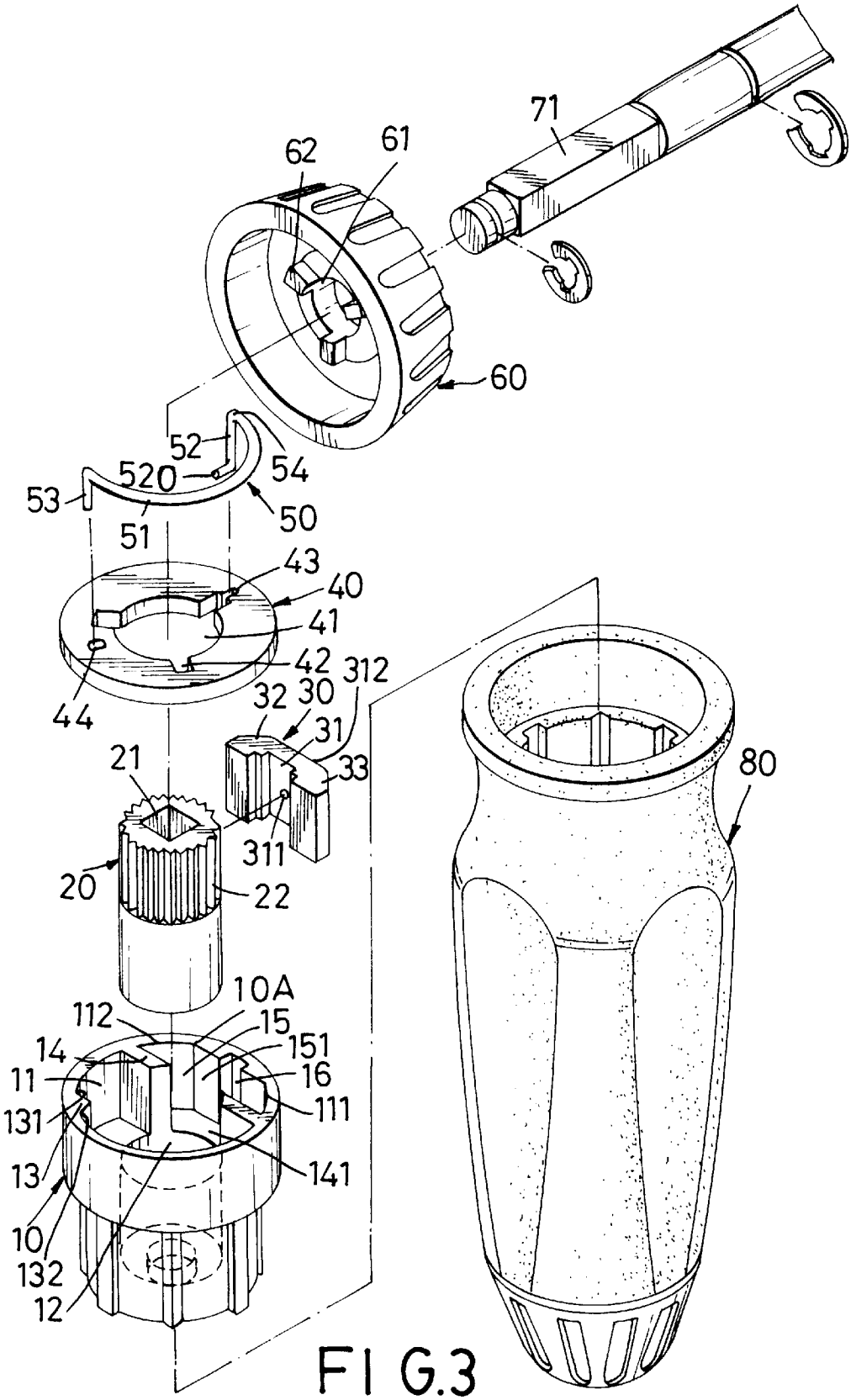
FIG. 3 is an exploded view of the preferred embodiment of a ratcheting driver handle of this invention.
Figure 4:
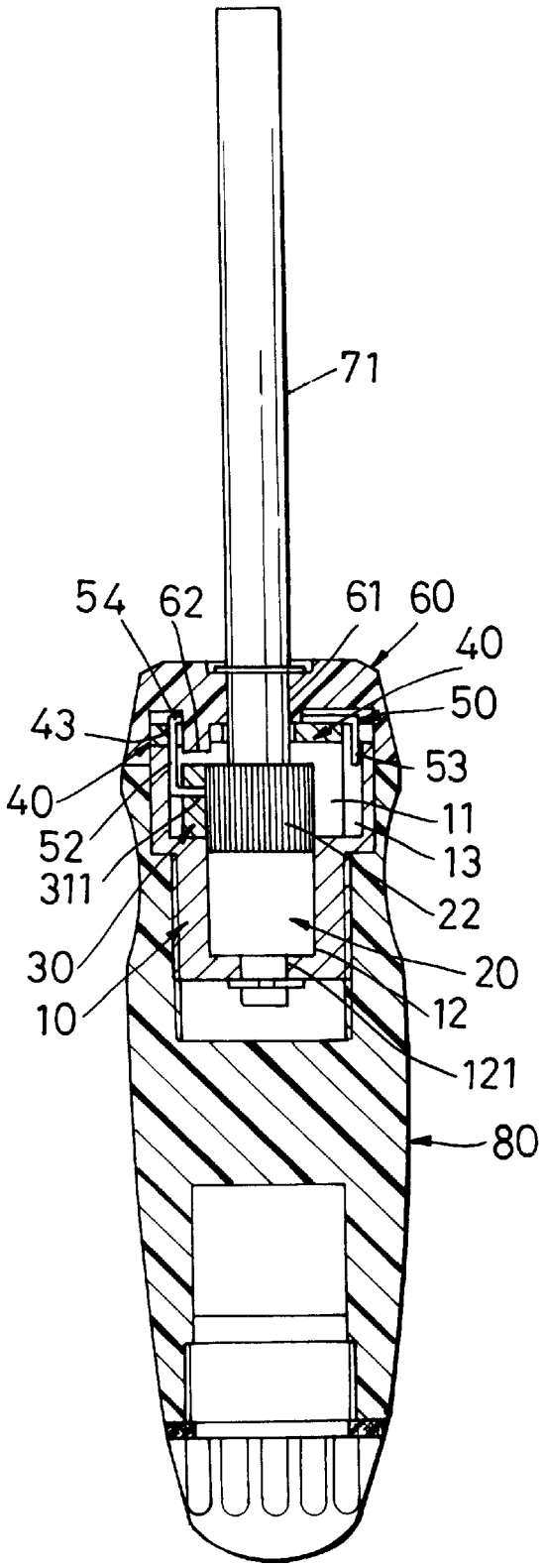
FIG. 4 is a schematic sectional view of the preferred embodiment.

Referring to FIGS. 3 and 4, the preferred embodiment of a ratcheting driver handle for a driver bit according to this invention is shown to include an elongated body 10, a ratcheting mechanism, a spring member 50, a retaining member 13, first and second barrier members 111, 112, and a shank 71.

As illustrated, the elongated body 10 has an end portion 10A formed with an inner annular wall 11 that extends in an axial direction to define an axial hole. The axial hole opens at the end portion 10A.

The ratcheting mechanism is disposed in the axial hole, and includes a gear member 20 that is disposed to be rotatable and coaxial relative to the axial hole. The gear member 20 has a coupling end 21 adapted to engage the shank 71, and a rim portion disposed around the axial direction. The rim portion is provided with a tooth member 22 that is spaced apart from the annular wall 11 in a radial direction to define an annular chamber 15 therebetween. The ratcheting mechanism further includes a pawl member 30 disposed in the annular chamber 15, and having a fulcrum point lying in a fulcrum line 31 parallel to the axial direction, and first and second tooth portions 33, 32 disposed at two sides of the fulcrum line 31 opposing each other in such a manner that one of the tooth portions 33, 32 engages the tooth member 22 when the fulcrum point 31 is shifted between first and second positions along a line parallel to a chord line relative to the gear member 20.

The spring member 50 includes a mounting end 52 secured to the fulcrum point 31, and a free end 53 that extends angularly from the mounting end 52 around the gear member 20. The free end 53 of the spring member 50 is slidably retained in first and second anchored points 132, 131 that are disposed angularly on the inner annular wall 11 when the fulcrum point 31 is shifted between the first and second positions 52*a*, 52*b*, respectively.

Figure 5:
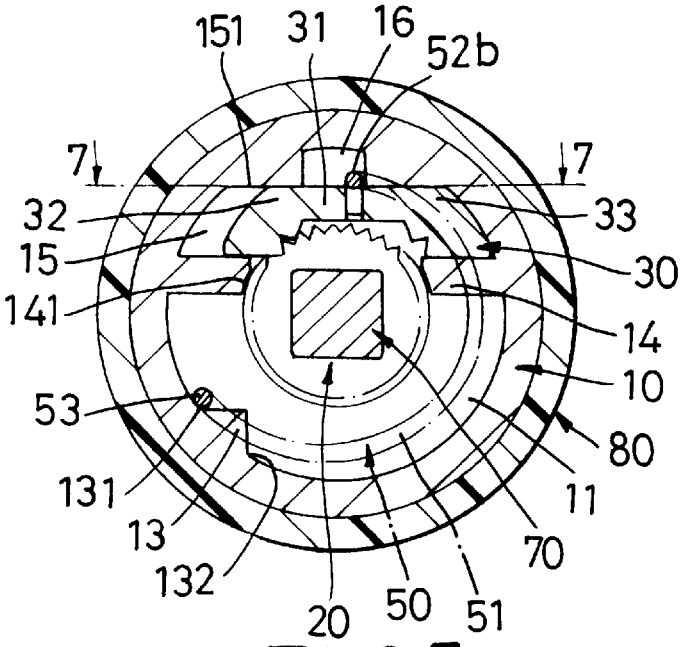
FIG. 5 is a fragmentary sectional view of the preferred embodiment, illustrating idle rotation of the handle.
Figure 6:
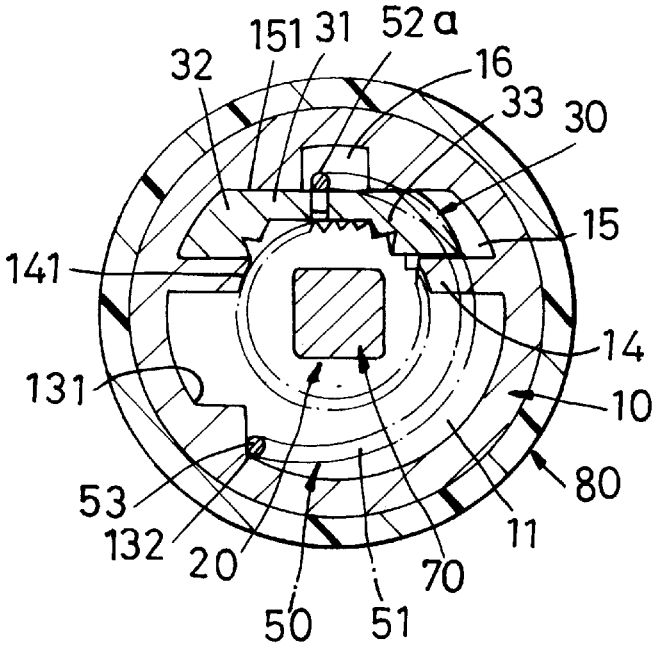
FIG. 6 is a fragmentary sectional view of the preferred embodiment, illustrating a state where the handle is rotated in the counterclockwise direction to perform a tightening operation on a workpiece.

The retaining member 13 is disposed on the inner annular wall 11 to slidably anchor the free end 53 at, in a clockwise direction, a downstream location which corresponds to the second anchored point 131 (see FIG. 5), and an upstream location which corresponds to the first anchored point 132 (see FIG. 6). The tooth member 22 is ratcheted by the second tooth portion 32 in a counterclockwise direction against a first biasing action of the spring member 50 generated when the free end 53 is at the second anchored point 131 and the mounting end 52 is at the second position 52*b*. The tooth member 22 is ratcheted by the first tooth portion 33 in the clockwise direction against a second biasing action generated when the free end 53 is at the first anchored point 132 and the mounting end 52 is at the first position 52*a*.

The first and second barrier members 111, 112 are disposed respectively to hinder the disengaged one of the first and second tooth portions 33, 32 from moving away from the tooth member 22 in the radial direction when one of the first and second tooth portions 33, 32 is brought to engage the tooth member 22 by shifting the fulcrum point 31 between the first and second positions 52*a*, 52*b*, thereby pulling or pushing the mounting end 52 so as to drag or to move over the free end 53 into the upstream location or the downstream location, respectively.

In the preferred embodiment, the elongated body 10 further includes an annular shoulder 141 disposed transversely on the inner annular wall 11 and inwardly of the end portion 10A so as to define a narrower inner annular wall 12 that extends in the axial direction for receiving rotatably the gear member 20 therein. The elongated body 10 further includes a pair of spaced partitions 14 formed on the annular shoulder 141 and extending toward the end portion 10A thereof to define in cooperation with the first and second barrier members 111, 112 a guideway 151 of a length greater than that of the pawl member 30 to permit shifting movement of the fulcrum point 31 between the first and second positions 52*a*, 52*b*. The pawl member 30 has an intermediate portion 311 formed between the first and second tooth portions 33, 32. The intermediate portion 311 extends along the axial direction, thereby serving as the fulcrum point 31. The elongated body 10 further includes an axially extending accommodating groove 16 formed in the inner annular wall 11 between the first and second barrier members 111, 112 and in communication with the end portion 10A to receive the mounting end 52 of the spring member 50 therein.

The preferred embodiment further includes a turnable disc 40 disposed transversely on the end portion 10A of the elongated body 10 and turnable around the axial direction so as to move the spring member 50 to shift the fulcrum point 31 in the guideway 151 between the first and second positions 52*a*, 52*b*. The turnable disc 40 has a central hole 41 adapted for passage of the shank 71, and two insert holes 44, 43 formed therethrough for passage of the mounting end 52 and the free end 53 of the spring member 50, respectively.

The preferred embodiment further includes a selector cap 60 disposed to be turnable around the axial direction and coupled to rotate the turnable disc 40. The selector cap 60 has a central hole 61 adapted for passage of the shank 71, and a plurality of angularly spaced plugs 62 disposed around the central hole 61. The turnable disc 40 further has a plurality of angularly spaced sockets 42 in alignment with the plugs 62 to receive the plugs 62 and transmit turning of the selector cap 60 to the turnable disc 40.

Figure 7:
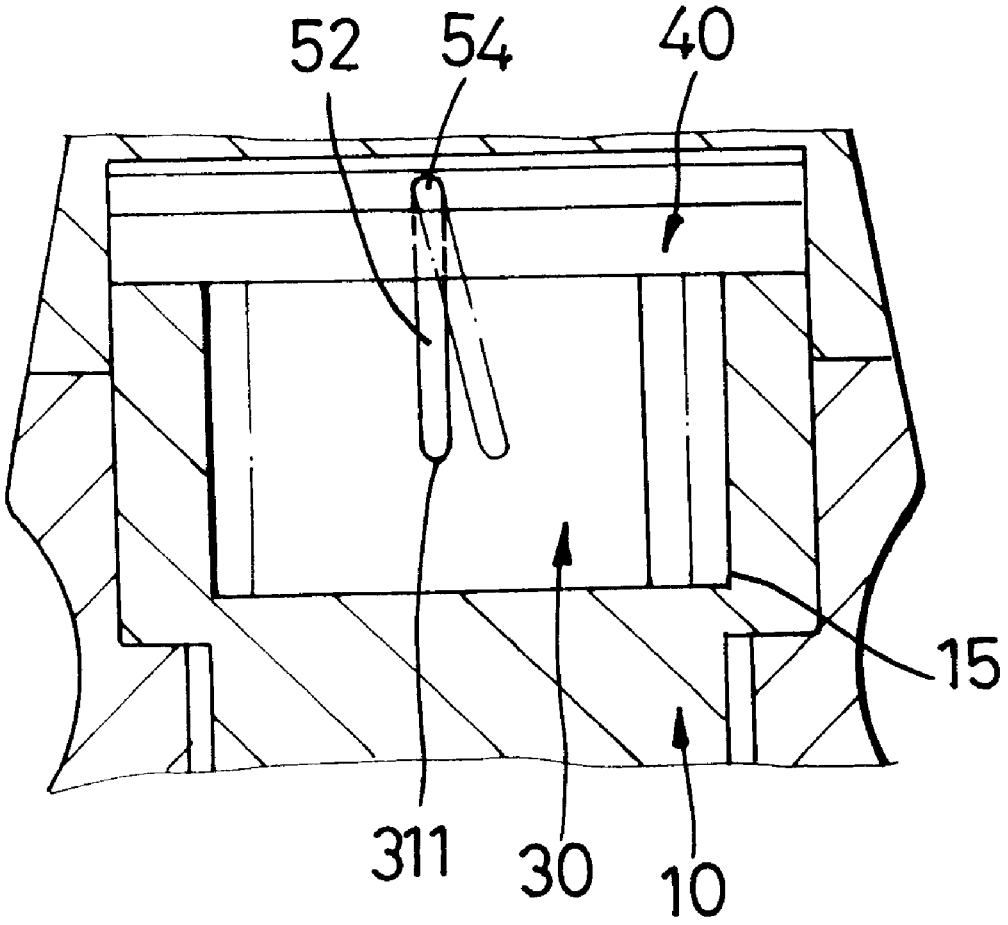
FIG. 7 is a sectional view of the preferred embodiment, illustrating how a gear member is kept to mesh constantly with the pawl unit in order to perform the tightening operation.

Referring to FIG. 7, note that the mounting end 52 is provided with an insert 520 (see FIG. 3) that projects inwardly and radially therefrom in order to facilitate insertion thereof in the intermediate portion 311 of the pawl member 30 such that the insert 520 swivels relative to the top portion 54 of the mounting end 52 so as to bring one of the first and second tooth portions 33, 32 to mesh constant with the tooth member 22 during idle rotation of the elongated body 10 so as to generate continuous clicking sounds.

The preferred embodiment further includes an outer housing 80 sleeved securely on the elongated body 10 to permit firm gripping thereof.

Because the pawl member 30 is swingeable about the insert 520 (serving as the fulcrum axis), little force is required to rotate the elongated body 10 to cause idle rotation thereof. When performing the tightening operation, the preferred embodiment provides an effective torque on the workpiece. Thus, the objects of this invention are achieved.

Figure 8:
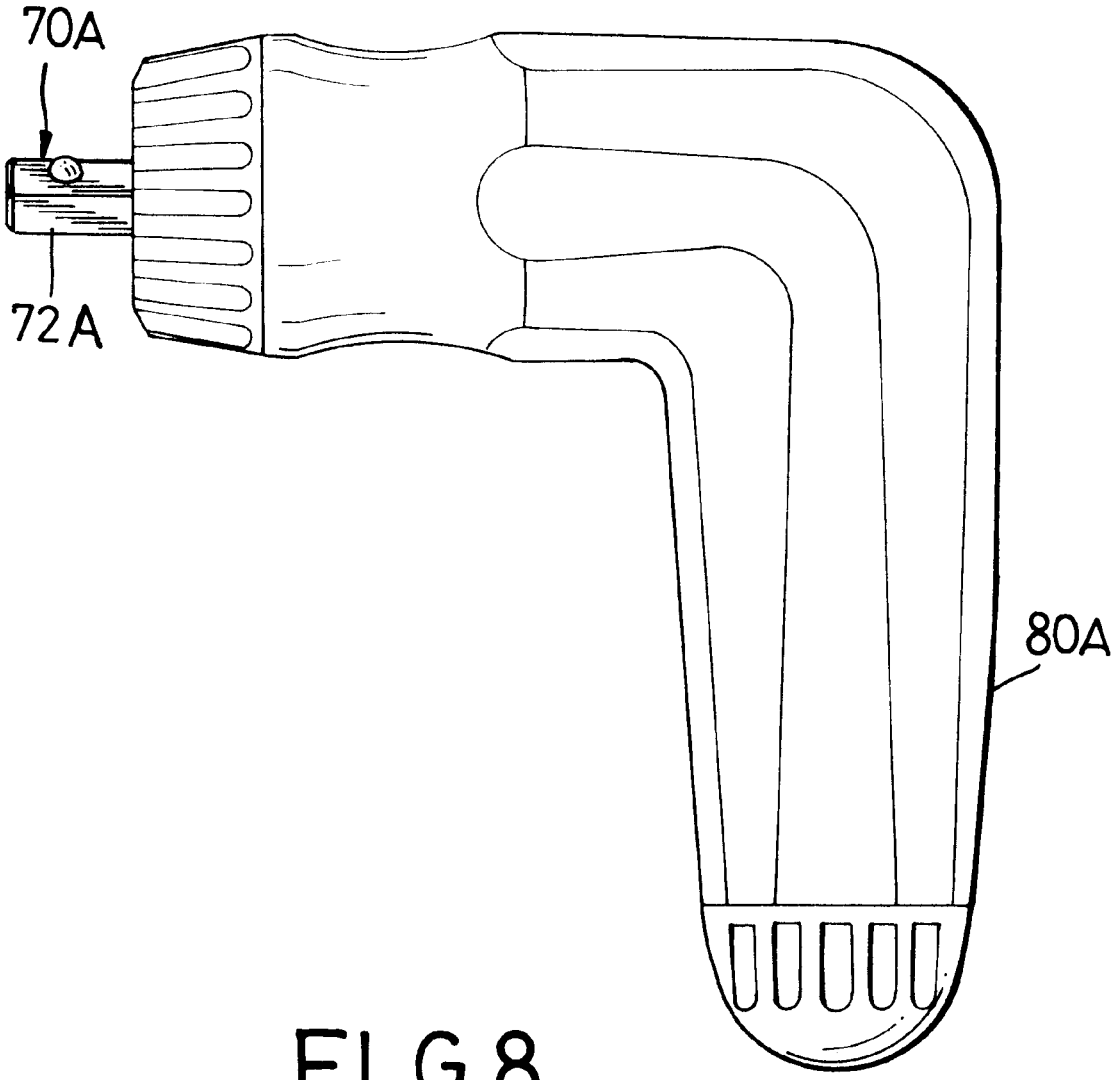
FIG. 8 is a modified preferred embodiment of this invention.

Referring to FIG. 8, a modified preferred embodiment of this invention is shown to similar to the previous embodiment in structure except in that the housing 80A is of an L-shaped while the shank 70A has an outer polygonal surface 72A. The features and objects are remained the same.

With this invention thus explained, it is apparent that numerous modifications and variations can be made without departing from the scope and spirit of this invention. It is therefore intended that this invention be limited only as indicated in the appended claims.

I claim:

1. A high torsion ratcheting driver handle for a driver bit having a shank, said handle comprising:

an elongated body having an end portion formed with an inner annular wall that extends in an axial direction to define an axial hole that opens at said end portion;

a ratcheting mechanism disposed in said axial hole, and including a gear member disposed to be rotatable and coaxial relative to said axial hole, said gear member having a coupling end adapted to engage the shank of the driver bit, and a rim portion disposed around said axial direction and provided with a tooth member that is spaced apart from said annular wall in a radial direction to define an annular chamber therebetween, said ratcheting mechanism further including a pawl member disposed in said annular chamber and having a fulcrum point lying in a fulcrum line parallel to said axial direction, and first and second tooth portions disposed at two sides of said fulcrum line opposing each other in such a manner that one of said first and second tooth portions engages said tooth member when said fulcrum point is shifted between first and second positions along a line parallel to a chord line relative to said gear member;

a spring member including a mounting end secured to said fulcrum point, and a free end extending angularly from said mounting end around said gear member, said free end being slidably retained in first and second anchored points that are disposed angularly on said inner annular wall when said fulcrum point is shifted between said first and second positions, respectively;

a retaining member disposed on said inner annular wall to slidably anchor said free end at, in clockwise direction, a downstream location which corresponds to said second anchored point, and an upstream location which corresponds to said first anchored point, wherein said tooth member is ratcheted by said second tooth portion in the counterclockwise direction against a first biasing action of said spring member generated when said free end is at said second anchored point and said mounting end is at said second position, and wherein said tooth member is ratcheted by said first tooth portion in the clockwise direction against a second biasing action generated when said free end is at said first anchored point and said mounting end is at said first position; and first and second barrier members disposed respectively to hinder the disengaged one of said first and second tooth portions from moving away from said tooth member in said radial direction when one of said first and second tooth portions is brought to engage said tooth member by shifting said fulcrum point between said first and second positions, thereby pulling or pushing said mounting end so as to drag or to move over said free end into said upstream location or said downstream location, respectively.

2. The high torsion ratcheting driver handle as defined in claim 1, wherein said elongated body further includes an annular shoulder disposed transversely on said inner annular wall and inwardly of said end portion so as to define a narrower inner annular wall extending in said axial direction for receiving rotatably said gear member therein.

3. The high torsion ratcheting driver handle as defined in claim 2, wherein said elongated body further includes a pair of spaced partitions formed on said annular shoulder and extending toward said end portion to define, in cooperation with said first and second barrier members, a guideway of a length greater than that of said pawl member to permit shifting movement of said fulcrum point between said first and second positions.

4. The high torsion ratcheting driver handle as defined in claim 3, wherein said elongated body further includes an axially extending accommodating groove formed in said inner annular wall between said first and second barrier members and in communication with said end portion to receive said mounting end of said spring member therein.

5. The high torsion ratcheting driver handle as defined in 4, further comprising a turnable disc disposed transversely on said end portion of said elongated body and turnable around said axial direction so as to move said spring member to shift said fulcrum point in said guideway between said first and second positions, said turnable disc having a central hole adapted for extension of the shank, and two insert holes formed therethrough for passage of said mounting end and said free end of said spring member, respectively.

6. The high torsion ratcheting driver handle as defined in claim 5, further comprising a selector cap disposed to be turnable around the axial direction and coupled to rotate said turnable disc, said selector cap having a central hole adapted for passage of the shank, and a plurality of angularly spaced plugs disposed around said central hole, said turnable disc further having a plurality of angularly spaced sockets in alignment with said plugs to receive said plugs and transmit turning of said selector cap to said turnable disc.

* * * * *